US005917471A

United States Patent [19]

Choi

[11] Patent Number: 5,917,471

[45] Date of Patent: Jun. 29, 1999

[54] METHOD FOR DISPLAYING GRAY SCALES OF IMAGE DISPLAY UNIT

[75] Inventor: Sun-Jung Choi, Suwon, Rep. of Korea

[73] Assignee: Samsung Display Devices, Co., Ltd., Kyungki-do, Rep. of Korea

[21] Appl. No.: 08/719,649

[22] Filed: Sep. 25, 1996

[30] Foreign Application Priority Data

Sep. 28, 1995 [KR] Rep. of Korea ..... 95-32496

[51] Int. Cl.[6] ..... G09G 5/10

[52] U.S. Cl. ..... 345/147; 345/89; 345/155

[58] Field of Search ..... 345/147, 89, 148–150, 345/153–155; 382/142–170, 237; 358/455–461; 348/671–675

[56] References Cited

FOREIGN PATENT DOCUMENTS 0626672 5/1994 European Pat. Off. .

9205509 4/1992 WIPO .

*Primary Examiner*—Steven J. Saras
*Assistant Examiner*—Seth D. Vail
*Attorney, Agent, or Firm*—Leydig, Voit & Mayer, Ltd.

[57] ABSTRACT

A gray scale display method includes converting the binary code of conventional picture data into an optimal code, based on display system characteristics. Gray levels of an image to be displayed are error-diffused and displayed using frame rate modulation. In order to reduce the likelihood of saturation of the gray levels, the maximum value of data displayed according to the optimal code is greater than or equal to the maximum value of the picture data displayed according to a conventional binary code. In addition, the number of adjacent gray levels is minimized. As a result, the driving voltage for driving electrodes in a display device and picture cross talk are reduced.

8 Claims, 10 Drawing Sheets

$$G_1(t) = -cF_1(t) + cF_2(t) - cF_3(t) + cF_4(t) + cF_5(t)$$

eA = (7/16) eP,eB = (1/16) eP,
eC = (5/16) eP,eD = (3/16) eP

METHOD FOR DISPLAYING GRAY SCALES OF IMAGE DISPLAY UNIT

BACKGROUND OF THE INVENTION

The present invention relates to a method for displaying multiple gray scales on an image display unit which can display all of the gray scales without a saturation area of gray levels having an effective voltage response characteristic and decreasing a driving voltage and sharply decreasing the ratio of a change in the amplitude of the driving voltage between subframes.

Generally, a liquid crystal display, a plasma display panel, or an electroluminescent display is used as the image display unit. A conventional method for displaying the gray scales of these image display units is as follows.

A matrix liquid crystal display device which is widely used as an image display unit at present basically includes scanning electrodes for controlling scanning lines thereof and data electrodes for controlling the display of data on the respective pixels when the respective scanning lines are selected. A voltage averaging method employing a line sequential driving method by means of a multiplexing technique, as shown in FIGS. 1(*a*)–1(*d*), is used as the standard method for driving such a simple matrix liquid crystal display device. FIGS. 1(*a*)–1(*c*) shows the waveforms of driving signals applied to the scanning electrodes and data electrodes when line sequentially driving the simple matrix crystal display device composed of 2×6 pixels by a voltage averaging method and the waveform of the signals applied to the pixels according to the driving signals of the scanning electrodes and data electrodes. In the line sequential driving method, pulses of the voltage Vs (a signal for driving scanning electrodes) are sequentially applied to the scanning electrodes (row numbers 1, 2, 3, 4, 5, and 6) as shown in FIG. 1(*a*) and pulses of the voltages +Vd and −Vd (a signal for driving the data electrodes) are applied to the data electrodes (column numbers 1 and 2) as shown in FIG. 1(*b*). Therefore, a device is driven as shown in FIG. 1(*d*) according to the pixel signals formed by the averaged voltage of the voltages Vs and Vd as shown in FIG. 1(*c*). Moreover, this method can be used without losing contrast of a picture only in case the response speed of liquid crystal is slow, usually, the response time of a liquid crystal device is about 400 msec.

Therefore, a MLS (multi-line scanning) method or an AA (active addressing) method is being used in the fields requiring a characteristic of high speed response corresponding to the moving speed of a mouse of a computer and to the speed of displaying a moving picture.

FIG. 2 shows the signals applied to the scanning electrodes and data electrodes when driving a liquid crystal display device by applying the MLS method or the AA method. As shown in FIG. 2, the MLS method is the method wherein a plurality of scanning electrodes (F1–F5; Let's assume that the five scanning electrodes are selected out of ten or more.) are simultaneously selected and driven at time t and the AA method is the method wherein all the scanning electrodes (F1–F5; Let's assume that only five scanning electrodes exist and all of them are selected.) are simultaneously selected and driven at time t. At this time, a signal for driving the data electrodes, displayed as G1(t)=−cF1(t)+cF2(t)−cF3(t)+cF4(t)+cF5(t) (c indicates an optional constant) is applied to the data electrode G1, thereby activating two pixels. A plurality of scanning electrodes which are simultaneously driven can be applied to a high speed response liquid crystal display device by increasing a duty ratio of a liquid crystal display device. However, many data voltage levels are required, and a storage unit containing picture data and an operation circuit are additionally required under the present driving circumstances.

For displaying the gray scales by the voltage averaging method adopting the line sequential driving method or the multi-line driving method (or the AA method) there are a frame rate modulation method, an amplitude modulation method, an area division method, a voltage and frame rate modulation method, a voltage amplitude modulation method, and an error diffusion method.

1. Frame Rate Modulation Method for Displaying the Gray Scales.

This method is most widely used for a simple matrix LCD, by which a plurality of subframes are set as a display unit of a screen to be driven. Using this method, gray levels are displayed according to the number of subframes activated among a plurality of subframes. This method is used as a standard for displaying the gray scales because driving expenditure is smallest, since the signals driving the scanning electrodes and those driving the data electrodes all have binary values which can control only the ON and OFF status of the liquid crystal. However, this method has a big problem in realizing the display speed required for displaying a moving picture, i.e., a display frequency of a screen decreases as the number of gray scales displayed increases. Also, a flicker generated due to the lowered screen display frequency deteriorates picture quality.

FIG. 3 shows the frame rate modulation method for displaying the gray scales realizing the eight gray scales using the seven subframes. Here, pulse widths and voltage signals for driving the scanning electrodes are t(s) and Vs, respectively. Also, Vns is a reference voltage and the voltage signals for driving the data electrodes are composed of +Vd and −Vd. As shown in FIG. 3, the method for increasing the frequency of displaying the second through seventh gray levels by increasing the number of subframes is applied, since the frequencies of the screen (the signals driving the data electrodes) are drastically reduced in the second and seventh gray levels. Here, actually, the signals driving the data electrodes are effective only when the signals driving the scanning electrodes are in the "on" state although the frequencies of the signals driving the data electrodes are equal (having a phase difference of 180°) in the second to seventh gray levels shown in FIG. 3. Therefore, the frequencies of the signals driving the data electrodes of displaying the second and seventh gray levels are the lowest.

2. Amplitude Modulation Method for Displaying the Gray Scales.

The amplitude modulation method for displaying the gray scales, as shown in FIG. 4, has an advantage that the signal driving the data electrodes (Y) and the signal driving the scanning electrodes (X), having a pulse width of d, are both composed of only two voltage levels, respectively. However, this method has problems wherein the driving frequencies increase as the pulse width (f) of a data electrode driving signal is divided according to the number of gray scales desired to be realized and wherein the liquid crystal display device cannot respond to the fast signals driving the data electrodes thereby, limiting the number of gray scales which can be displayed.

3. Area Division Method for Displaying the Gray Scales.

The area division method for displaying the gray scales is not used except for special cases because of the problem of lowering resolution, i.e., increase in the number of driving ICs and scanning lines of the screen.

4. Voltage and Frame Rate Modulation Method for Displaying the Gray Scales.

The voltage and frame rate modulation method for displaying the gray scales, as shown in FIG. 5, is a method for allotting subframes to the respective data bits and controlling the amplitudes of the driving voltages considering the weighting values of the respective bits. In the voltage and frame rate modulation method for displaying the sixteen gray scales as shown in FIG. 5, the ratio of the amplitude of the driving voltage Vs to that of the driving voltage Vd is 2√2:2:√2:1 in the respective frames as the data system is 8:4:2:1. Namely, the difference of the driving voltages between the respective subframes is large and the amplitudes of the driving voltages increase. In this method, in case LCD is driven by the most significant bit data signal under the conditions of the duty 1/240 and Vth 2.0 V the amplitude of the scanning electrode driving signal Vs becomes 35.4 V. In the frame rate modulation method, the amplitude of the scanning electrode driving signal Vs becomes about 22.65 V under the same case and conditions above. It shows an increase of Vs of about 1.56 times as compared with that in the frame rate modulation method. Therefore, since the magnitude difference of the driving voltage levels and that of the subframes becomes larger with an increased number of gray levels, the number of displayed gray levels should be limited. However, this method is estimated to be of possible practical use in the future due to the advantages that it is possible to minimize the number of electrical potentials driving the data electrodes and to sharply reduce the number of subframes in spite of the wide difference in the amplitudes of the driving voltages between the respective subframes.

5. Voltage Amplitude Modulation Method for Displaying the Gray Scales.

The voltage amplitude modulation method for displaying the gray scales is being studied, since it may be used to realize a liquid crystal display device for a high speed response with the development of a method for simultaneously selecting a plurality of electrodes (the active address method). The pulse height modulation (PHM) method, as shown in FIG. 6, is a representative example of this type of application. Here, the pulses of the signals driving the data electrodes (Y), the heights of which are different in the respective half sections (dt/2) of the selected pulse widths (dt) of signals driving the scanning electrodes (X), are applied to the data electrodes. In this method, the expenses for the driving ICs are drastically increased, as countless numbers of electrical potentials for driving the data electrodes are required. Also, there is much to be improved including the limitations of the data processing speed in case the ICs of the analog method are used.

6. Error Diffusion Method for Displaying the Gray Scales.

The error diffusion method for displaying the gray scales is the method for displaying the gray scales by performing space modulation using a picture processing technology. This method is being studied because it allows a sufficient amount of gray scales to be displayed without increasing the expenses for driving the image display unit.

The space modulation method for displaying the gray scales adopting the error diffusion method is performed by an error diffusion system as shown in FIG. 7. In this system, an effective value ($u_{m,n}$) obtained by subtracting an error value ($e'_{m,n}$), generated at the previous pixels, from the original pixel data ($x_{m,n}$) considered as being displayed is approximated into a quantization value ($b_{m,n}$) to be used as picture display data. The difference between the effective value ($u_{m,n}$) and the quantization value ($b_{m,n}$) is set as a new error value ($e_{m,n}$) to be diffused into adjacent pixels in a predetermined ratio according to the error diffusion method. These options are sequentially adopted according to the scanning direction thereby displaying desired gray levels. Here, Q(*) denotes a quantizer and $h_{m,n}$ denotes a low pass filter. The respective values of the error diffusion system are defined by the following formulas:

$$u_{m,n}=x_{m,n}-e'_{m,n} \quad 1.)$$

$$b_{m,n}=Q(u_{m,n}) \text{ (quantized)} \quad 2.)$$

$$e_{m,n}=b_{m,n}-U_{m,n} \quad 3.)$$

$$e'_{m,n}=h_{m,n}(e_{m,n}) \text{ (Low-pass filtering)} \quad 4.)$$

The Floyd and Steinberg algorithm is most generally used as a method for diffusing the error values generated in this system to the peripheral pixels, although the Jarvis algorithm, the Judice and Ninke algorithm, and the Stucki algorithm are also widely used therefor. Furthermore, various algorithms other than these are developed and applied according to the application methods.

In the Floyd and Steinberg algorithm, as shown in FIG. 8, the error diffusion is performed for the error to be diffused by 7/16 (eA), 1/16 (eB), 5/16 (eC), and 3/16 (eD), respectively, to the peripheral pixels A, B, C, and D at the pixel P. At this time, the picture data undergoes error diffusion processing in the order shown in the algorithm of FIG. 12. Namely, the picture data of N bits is input, the less significant n bits (n is an integer, i.e., 1, 2, 3, etc.) among the N bits undergo error diffusion processing, and the picture data of (N−n) bits is displayed as a picture.

However, this method has a problem of having a saturation area at the most significant gray level, which is shown in FIG. 9.

FIG. 9 shows substantial gray display states according to the gray level display capability of a display device in the case of displaying 8-bit data using the error diffusion method. Here, "a" depicts a substantial gray level display state in the case of an LCD having two gray levels, in which the gray levels exceeding 128 (a half of the maximum gray level display number of 8-bit data, $2^8$=256) become saturated, thereby unable to discern the gray levels. Lines b, c, and d depict gray display states in the case of LCDs having 4, 8, and 16 gray levels, respectively. Also, "e" denotes the 256 gray scales, which is the limit of displaying the eight bit data.

SUMMARY OF THE INVENTION

It is an object of the present invention to provide a method for displaying gray scales of an image display unit wherein it is possible to sharply lower a driving voltage, to sharply reduce the difference of the amplitudes of the driving voltages, and to minimize deterioration of a picture quality due to space modulation by partially applying an error diffusion method to only a gray level having an extremely low frequency of generation.

To achieve the above object, there is provided a method for displaying gray scales of an image display unit, comprising the steps of determining an error diffusion processing value of input picture data of N bits as n bits which is less than N, converting the picture data of N bits into the optimal data code of M bits which is larger than or equal to N and is composed of a picture data code of (M−n) bits selected to satisfy the first standard for selecting the code wherein the maximum value of the data of the upper (M−n) bits displayed by the optimal code system should be equal to or larger than the maximum value of the picture data displayed according to the binary code system and the second standard for selecting the code wherein, among the new gray levels generated by the error diffusion method, the number of adjacent gray levels should be smallest and an additional code of n bits for space modulation, error-diffusion-processing n bits being the error diffusion processing value among the picture data which are converted into the optimal M bits, and displaying the picture data code of the (M−n) bits wherein the n bits undergo error diffusion processing as a picture.

The step for converting the picture data of N bits into the optimal data code of M bits is preferably performed to satisfy the third standard for selecting the code, wherein the optimal code system should minimize the difference of the weighting values of the data values between the most significant bit and the least significant bit and the fourth standard for selecting the code, wherein the optimal code system should minimize the difference of the weighting values between the respective data bits when there exist more than two code systems which simultaneously satisfy said first and second standards for selecting the code.

The gray scales of the picture data code of (M−n) bits are preferably displayed using the voltage amplitude modulation method or the voltage and frame rate modulation method in the step for displaying the picture.

To achieve the above object, there is provided another method for displaying gray scales of an image display unit, comprising the steps of determining an error diffusion processing value of input picture data of N bits as n bits which is smaller than N, converting the picture data of N bits into the optimal data code of M bits which is greater than or equal to N bits and composed of a picture data code of (M−n) bits selected to satisfy the third standard for selecting the code, wherein the optimal code system should minimize the difference of the weighting values of the data values between the most significant bit and the least significant bit and the fourth standard for selecting the code, wherein the optimal code system should minimize the difference of the weighting values between the respective data bits, and an additional code of n bits for a space modulation, error-diffusion-processing n bits being the error diffusion processing value among the picture data which are converted into the optimal M bits, and displaying the picture data code of the (M−n) bits wherein the n bits undergo the error diffusion processing as a picture.

The step for converting the picture data of N bits into the optimal data code of M bits is performed to satisfy the first standard for selecting the code, wherein the maximum value of the data displayed by the optimal code system should be equal to the maximum value of the picture data displayed according to the binary code system and the second standard for selecting the code wherein, among the new gray levels generated by the error diffusion method, the numbers of adjacent gray levels should be smallest, when there exist more than two code systems which simultaneously satisfy the third and fourth standards for selecting the code.

The gray scales of the picture data code of (M−n) bits are preferably displayed using the voltage amplitude modulation method or the voltage and frame rate modulation method in the step for displaying the picture.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
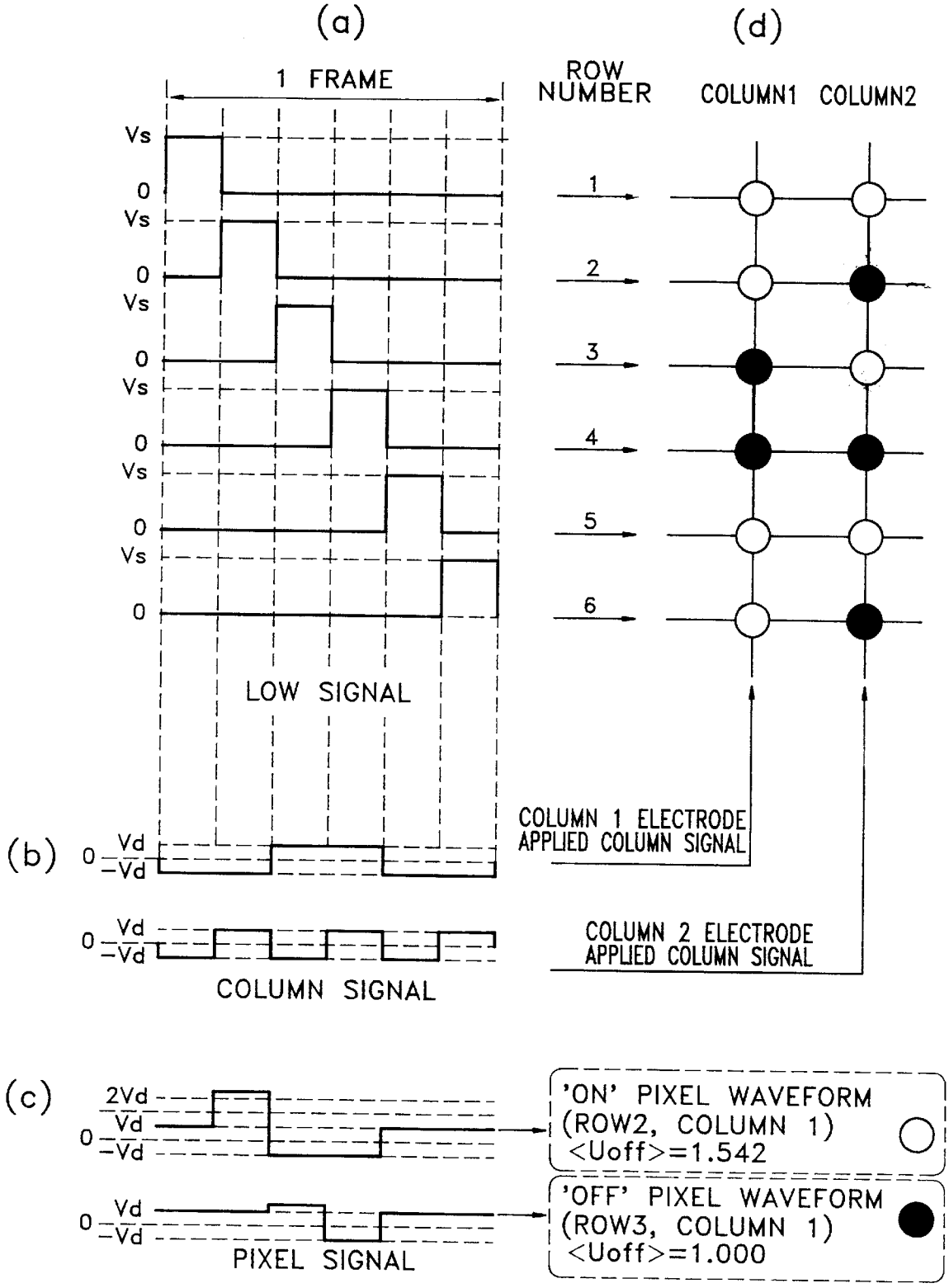
FIG. 1 (PRIOR ART)
FIGS. 1(*a*)–1(*d*) shows waveform diagrams of signals for driving scanning electrodes and data electrodes of a matrix line sequential driving method by a conventional voltage averaging method and signals applied to pixels for driving scanning electrodes, and a matrix array of the pixels.

Hereinafter, a method for displaying gray scales of an image display unit according to the present invention and a device therefor are described with reference to FIGS. 10, 11, 13, 14, and 15.

The present invention is a new gray scale display method in which the binary data code of a conventional picture data is converted into an optimal code, considering circumstances of the display system such as LCD characteristics, the number of subframes for displaying the gray scales, and the driving voltage condition using a space modulation technology such as an error diffusion method. Namely, after the gray levels whose occurrence frequencies are low among the converted code values are partially error-diffused, these error diffused gray levels and other converted code values are displayed to gray scales by a voltage and frame rate modulation method.

A standard for selecting picture data for code conversion is as follows.

1. The maximum value of the data displayed by the optimal code system should be equal to or larger than the maximum value of the picture data displayed according to the conventional binary code system.

2. Among the new gray levels generated by the error diffusion method, the number of adjacent gray levels should be smallest.

In case that two or more code systems satisfying the first and second standards for selecting a code exist, the optimal code system should be determined according to the following standards for selection.

3. The code system should minimize the difference in the weighting values between data values of the most significant bit and the least significant bit.

4. The code system should minimize the difference in the weighting values between respective data bits.

Among the above four standards for selecting a code, the first standard is for solving the problem of a saturation area being generated in the gray levels due to the application of the error diffusion method and the second standard is for securing an accurate display of the gray scales and minimizing a deterioration of picture quality, which is described in detail in the following 16-gray-scale code system. The third and fourth standards are for improving the characteristics of the driving voltage.

The following code systems of 3 bits and 4 bits serve as examples for converting a code system for displaying the 16 gray scales. A conventional binary code system for displaying the 16 gray scales is composed of the 4 bits "8:4:2:1." While, only the data code of the 3 bits "8:4:2" remains in case that only the least significant bit undergoes the error diffusion processing in a binary code system and the picture data for displaying the 16 gray scales are made thereby. In this case, the area above the gray scale value of 14 becomes a saturation area.

3-Bit Code System

The optimal code system for displaying the 16 gray scales using a 3 bit code system is selected by the following procedures. First, if 3-bit data codes which satisfy the above first standard for selection and do not generate overlap of the gray scale values among the data values for displaying the 16 gray scales are derived, the following 12 code systems are derived.

(MSB, LSB + 1, LSB) = (12,2,1), (11,3,1), (10,4,1), (9,5,1) (8,6,1), (10,3,2), (9,4,2), (8,5,2), (7,6,2), (8,4,3), (7,5,3), (6,5,4)

The new gray scale values generated by applying the error diffusion method to the respective data codes are shown in the following TABLE 1. The values underlined in TABLE 1 indicate the values of adjacent gray scales. The cases, wherein the sequence of values of adjacent gray scales is less than 2, can be used without sharply deteriorating the accuracy of the display of gray scales (according to the second standard for selecting a code). Therefore, the optimal code system is selected among the data codes (9,4,2), (8,5,2), (8,4,3), and (7,5,3).

The values of gray scales according to the error diffusion method are obtained using the values other than those obtained by a combination of bit values of the data code. For example, in case of the data code (12,2,1), the values obtained by the combination are 1, 2, 3(=1+2), 12, 13(=12+1), 14(=12+2), 15(=12+2+1). Here, the values of 4, 5, 6, 7, 8, 9, 10, and 11 are required for filling up all the values of the gray scales of 16 bits. These values of the gray scales are filled up by the error diffusion method.

TABLE 1

| data code | values of gray scales by the error diffusion method |
|---|---|
| 12,2,1 | 4, 5, 6, 7, 8, 9, 10, 11 |
| 11,3,1 | 2, 5, 6, 7, 8, 9, 10, 13 |
| 10,4,1 | 2, 3, 6, 7, 8, 9, 12, 13 |
| 9,5,1 | 2, 3, 4, 7, 8, 11, 12, 13 |
| 8,6,1 | 2, 3, 4, 5, 10, 11, 12, 13 |
| 10,3,2 | 1, 4, 6, 7, 8, 9, 11, 14 |
| * 9,4,2 | 1, 3, 5, 7, 8, 10, 12, 14 |
| * 8,5,2 | 1, 3, 4, 6, 9, 11, 12, 14 |
| 7,6,2 | 1, 3, 4, 5, 10, 11, 12, 14 |
| * 8,4,3 | 1, 2, 5, 6, 9, 10, 13, 14 |
| * 7,5,3 | 1, 2, 4, 6, 9, 11, 13, 14 |
| 6,5,4 | 1, 2, 3, 7, 8, 12, 13, 14 |

The data code (9, 4, 2), among the four data codes with asterisk marks (satisfying the second standard for selection), is excluded from the objects of selection of the optimal code system as it does not satisfy the above third and fourth standards for selection and solves only the saturation region of the gray scales which satisfies the first standard for selection. That is, the ratio of the most significant bit to the least significant bit is 4.5 (=9/2), which is larger than that in the case wherein the least significant bit undergoes the error diffusion processing in a conventional binary code system, i.e., 4. Also, in picture quality is more severe than in the remaining two code systems since it has four sets of gray scale values which are comprised of two respective gray scale values, which does not satisfy the second standard for selection. As a result, the optimal code system is selected between the code systems (8, 5, 2) and (7, 5, 3). These two code systems have the same number of adjacent gray levels (i.e., two continual gray level values) and the same number of sets of gray scale values (i.e., two sets) which are comprised of two adjacent gray level values. Therefore, the optimal code system is selected according to the third and fourth standards for selection.

Figure 10:
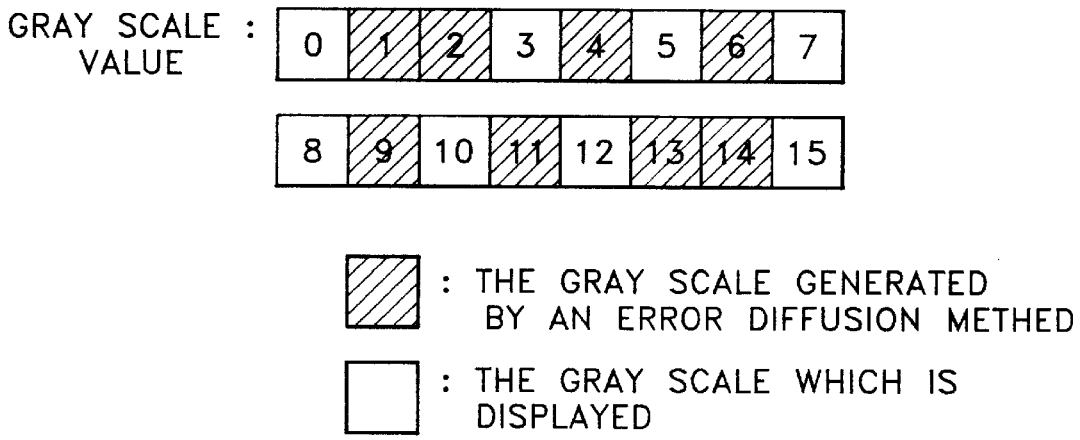
FIG. 10 is a diagram showing a method for displaying the 16 gray scales using the optimal code system of 3 bits.

The code system (7, 5, 3) is selected as the optimal code system, since in the code systems (8, 5, 2) and (7, 5, 3), the ratios of the most significant bit to the least significant bit are 4 (8/2) and 2.3 (7/3), respectively, and the difference of weighting values between the data bits are 3 and 2, respectively. FIG. 10 shows a diagram representing the 16 gray scales when using the code system of the 3 bits (7, 5, 3). As shown in FIG. 10, in the code system in which a space is converted, the number of gray scales displayed is eight (0, 3, 5, 7, 8=3+5, 10=3+7, 12=5+7, and 15=3+5+7) and those newly generated according to the space modulation of the error diffusion method are eight (1, 2, 4, 6, 9, 11, 13, and 14).

The following TABLE 2 shows the state of the displayed gray scales, wherein the least significant bit undergoes error diffusion processing (using a weighting value code of 8:4:2) in the conventional binary code system and that of the method for displaying the gray scales according to the present invention (using a weighting value code of 7:5:3).

TABLE 2

| values of gray Scales | conventional method | method according to the present invention |
|---|---|---|
| 0 | 0 | 0 |
| 1 | error diffusion | error diffusion |
| 2 | 2 | error diffusion |
| 3 | error diffusion | 3 |
| 4 | 4 | error diffusion |
| 5 | error diffusion | 5 |
| 6 | 6 | error diffusion |
| 7 | error diffusion | 7 |
| 8 | 8 | 8 |
| 9 | error diffusion | error diffusion |
| 10 | 10 | 10 |
| 11 | error diffusion | error diffusion |
| 12 | 12 | 12 |
| 13 | error diffusion | error diffusion |
| 14 | 14 | error diffusion |
| 15 | 14(in saturation state) | 15 |

As shown in TABLE 2, the area wherein the value of the gray scales is 14 or more is in a saturation condition in the conventional method.

The regeneration of the brightness level corresponding to the values of gray scales generated by application of the error diffusion is sharply affected by the values of the adjacent gray scales which are sequentially generated, among the values of the new gray scales generated by the error diffusion processing.

As an example, when the data code system of (7, 5, 3) is used, it is possible to display the brightness level corresponding to the gray scale 4 since it is generated as the value which underwent a space modulation by the error diffusion processing and the gray scales 3 and 5 are displayed on the screen in the ratio of 50:50 when it is displayed on the screen. While, displaying the value of gray scale 1 on the screen, the values of gray scales 0 and 3 are displayed on the screen in the proportion of 66.6% and 33.3% since the value of gray scale 1 and gray scale 2 are generated together by the error diffusion processing. Therefore, the chances that the pixels each having a brightness, in which the difference of the gray scale values is 3, are discerned on the screen become larger and the correct display of the brightness of the gray scale value 1 becomes more difficult since the pixels occupy ⅓ and ⅔ of the screen.

4-Bit Code System

The only code which can display the 16 gray scales by only the 4 bit code itself is (8, 4, 2, 1). This code system makes it possible to correctly display the 16 gray scales but the driving voltage thereof is high and the variation rate of the driving voltage for displaying subframes thereof is also large since a ratio of the most significant bit to the least significant bit is 8 (8/1). (Please refer to TABLE 5.)

In an application example of such a code system having 4 bits, the values having the minimum number of the neighboring gray levels among the values of the 16 gray scales undergo space modulation by applying the error diffusion method, and the code system wherein the driving voltage is sharply lowered is selected to determine the optimal code system. The number of code systems which satisfy the first standard for selecting the optimal code system and display the 16 gray scales is 18, as follows.

(MSB,LSB+2,LSB+1,LSB)=(9,3,2,1),(7,5,2,1),(6,6,2,1),
(8,3,3,1),(7,4,3,1),(6,5,3,1),
(6,4,4,1),(5,5,4,1),(8,3,2,2),
(7,4,2,2),(6,5,2,2),(7,3,3,2),
(6,4,3,2),(5,5,3,2),(5,4,4,2),
(6,3,3,3),(5,4,3,3),(4,4,4,3).

Among such data code systems, the new values of the gray scales generated by applying the error diffusion method to the remaining code systems, except for the code systems wherein the ratio of the data value of the most significant bit to that of the least significant bit is equal to or larger than that of the conventional binary code system, are shown in the following TABLE 3.

TABLE 3

| data code | values of gray scales by the error diffusion method |
|---|---|
| 7,5,2,1 | 4, 11 |
| 6,6,2,1 | 4, 5, 10, 11 |
| 7,4,3,1 | 2, 6, 9, 13 |
| 6,5,3,1 | 2, 13 |
| 6,4,4,1 | 2, 3, 12, 13 |
| 5,5,4,1 | 2, 3, 7, 8, 12, 13 |
| 8,3,2,2 | 1, 6, 9, 14 |
| 7,4,2,2 | 1, 3, 5, 10, 12, 14 |
| 6,5,2,2 | 1, 3, 12, 14 |
| 7,3,3,2 | 1, 4, 11, 14 |
| 6,4,3,2 | 1, 14 |
| 5,5,3,2 | 1, 4, 6, 9, 11, 14 |
| 5,4,4,2 | 1, 3, 12, 14 |
| 6,3,3,3 | 1, 2, 4, 5, 7, 8, 10, 11, 13, 14 |
| 5,4,3,3 | 1, 2, 13, 14 |
| 4,4,4,3 | 1, 2, 5, 6, 9, 10, 13, 14 |

The code systems having the smallest number of the new gray scale values generated by applying the error diffusion in TABLE 3 are as follows:

(MSB,LSB+2,LSB+1,LSB)=(7,5,2,1),(6,5,3,1),(6,4,3,2).

Figure 11:
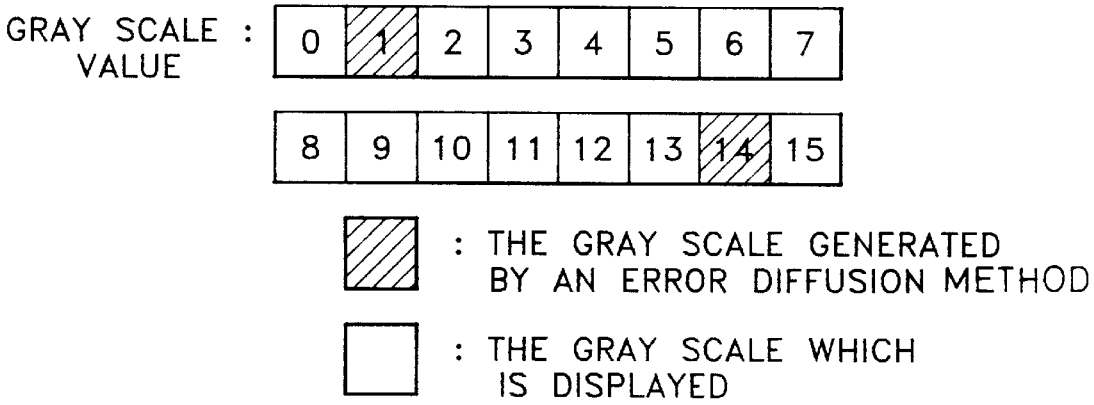
FIG. 11 is a diagram showing a method for displaying the 16 gray scales using the optimal code system of 4 bits.

The optimal code system is selected by the third and fourth standards for selecting the optimal code system as all of these code systems have two new values of gray scales by the application of the error diffusion processing. Therefore, the code system (6,4,3,2) which has the smallest ratio of the most significant bit to the least significant bit is selected to be the optimal code system. The 16 gray scales displayed using the code system (6,4,3,2) are shown in FIG. 11.

Figure 12:
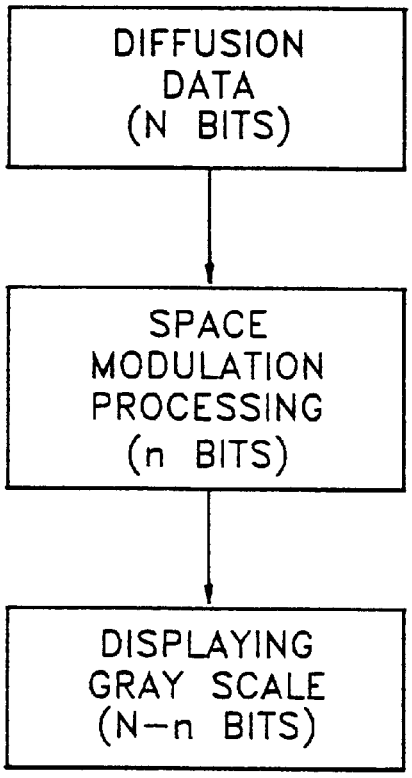
FIG 12 (PRIOR ART)
FIG. 12 is a flowchart diagram of a picture data processing algorithm according to a conventional error diffusion method.
Figure 13:
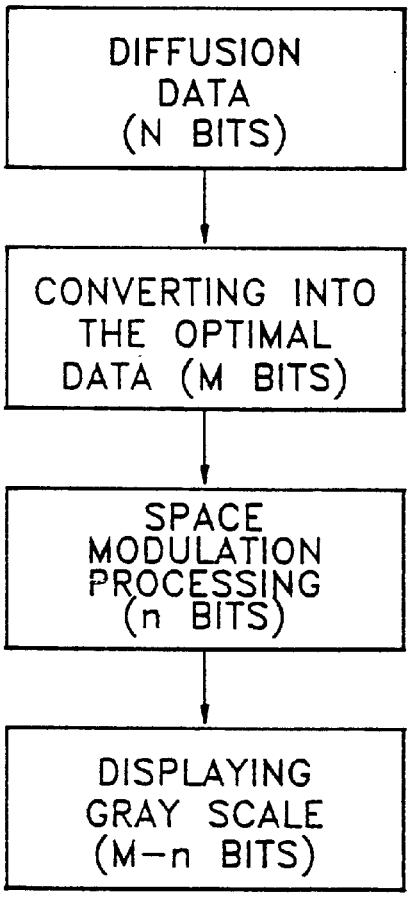
FIG. 13 is a flowchart diagram of a picture data processing algorithm of an error diffusion method according to the present invention.

The standards for selecting the optimal code can be applied to gray scales of 16 or more and to those of 16 or less. The method for displaying the gray scales, using the optimal code system, is embodied by the algorithm shown in FIG. 13, while, in the conventional error diffusion method shown in FIG. 12, the picture data of the upper (N−n) bits is displayed on the image display unit using the modulated picture data obtained after having the lower n bits of (n is an integer, i.e., 1, 2, 3, etc.) the picture data of N bit undergo the data processing by the error diffusion algorithm. This procedure is explained in the following steps.

Firstly, the code of the binary picture data of N bits is converted to the M bit code which is optimal for displaying the gray scales of the liquid crystal display device. Namely, the picture data of N bits are changed to the optimal code system (M−n), selected by the standard for selecting the optimal code and the additional code (n bits) for the space modulation processing.

Secondly, the additional code of n bits (n is an integer, i.e., 1, 2, 3, etc.), for the space modulation processing, among the picture data converted into M bits undergo space modulation. The conventional error diffusion method or the method appropriate for the characteristics of the display can be used as the space modulation method.

Finally, the picture data modulated to the optimal code system (M−n) bits) are displayed to gray scales, by the method for displaying the gray scales.

In case the picture data composed of this optimal code conversion system are displayed into 16 gray levels using three subframes like in the conventional voltage and frame modulation method, the following code conversion may be performed.

As an example of the above optimal code conversation method, the conversion of the picture data into the optimal 3-bit code system (7, 5, 3) previously obtained in TABLE 1 for displaying the 16 gray scales and the additional code (1, 1), are shown in TABLE 4.

TABLE 4

| code weighting | binary code data | | | | the optimal code data | | | | |
|---|---|---|---|---|---|---|---|---|---|
| value | 8 | 4 | 2 | 1 | 7 | 5 | 3 | 1 | 1 |
| 0 | 0 | 0 | 0 | 0 | 0 | 0 | 0 | 0 | 0 |
| 1 | 0 | 0 | 0 | 1 | 0 | 0 | 0 | 0 | 1 |
| 2 | 0 | 0 | 1 | 0 | 0 | 0 | 0 | 1 | 1 |
| 3 | 0 | 0 | 1 | 1 | 0 | 0 | 1 | 0 | 0 |
| 4 | 0 | 1 | 0 | 0 | 0 | 0 | 1 | 0 | 1 |
| 5 | 0 | 1 | 0 | 1 | 0 | 1 | 0 | 0 | 0 |
| 6 | 0 | 1 | 1 | 0 | 0 | 1 | 0 | 0 | 1 |
| 7 | 0 | 1 | 1 | 1 | 1 | 0 | 0 | 0 | 0 |
| 8 | 1 | 0 | 0 | 0 | 0 | 1 | 1 | 0 | 0 |
| 9 | 1 | 0 | 0 | 1 | 1 | 1 | 1 | 0 | 1 |
| 10 | 1 | 0 | 1 | 0 | 1 | 0 | 1 | 0 | 0 |
| 11 | 1 | 0 | 1 | 1 | 1 | 0 | 1 | 0 | 1 |
| 12 | 1 | 1 | 0 | 0 | 1 | 1 | 0 | 0 | 0 |
| 13 | 1 | 1 | 0 | 1 | 1 | 1 | 0 | 0 | 1 |
| 14 | 1 | 1 | 1 | 0 | 1 | 1 | 0 | 1 | 1 |
| 15 | 1 | 1 | 1 | 1 | 1 | 1 | 1 | 0 | 0 |

The logic of the code conversion from TABLE 4 is as follows.

converted code conventional code

7=(8^4)+(8^4^2)+(4^2^1)

5=(8^4)+(8^4^2)+(8^4)+(2⊕1)

3=(8^4)+(8^2^1)+(4^2^1)+(8^4^2^1)

1=(8⊕4)^2^1

1=(4^2^1)+{(8^1)^(4^2)}+{(8^1)^(4⊕2)}+(4^2^1)

Also, the conversion into the optimal code system (6, 4, 3, 2) for displaying the 16 gray scales of 4 bits, previously obtained in TABLE 3, and the additional code 1, as another example of the method for converting to the optimal code, can be performed by the above method.

The picture data is modulated by undergoing space modulation, using the conventional error diffusion processing method like the Floyd and Steinberg algorithm, after it is converted into the optimal code.

Next, the gray scales of the modulated picture data are displayed. Here, almost all of the methods for displaying the gray scales, i.e., the voltage amplitude modulation method and the voltage and frame rate modulation method, etc., can be used.

Figure 14:
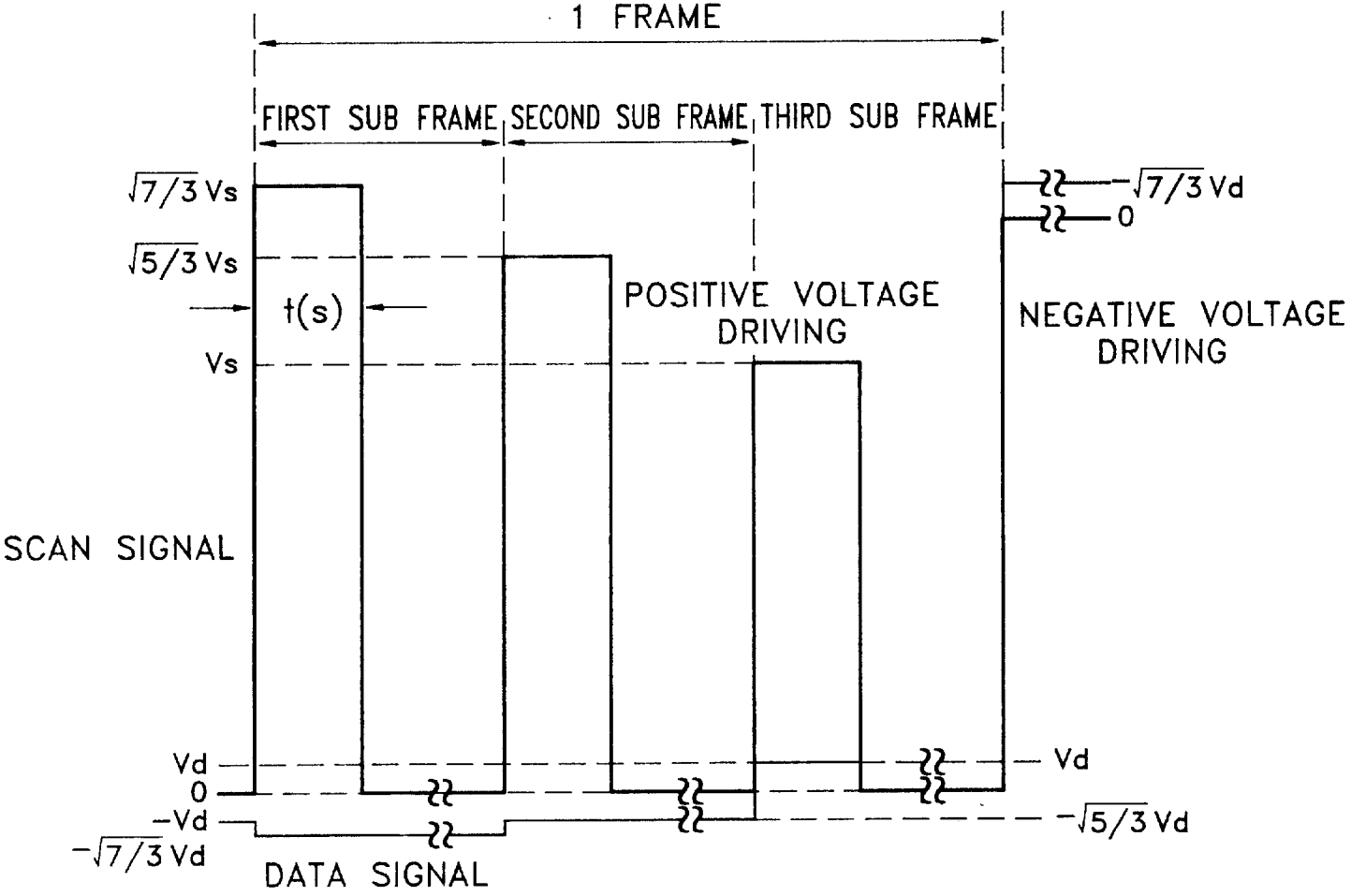
FIG. 14 is a waveform diagram showing an example of the signals for driving the scanning electrodes and those for driving the data electrodes according to the method for displaying the gray scales according to the present invention.

The driving voltages and the waveforms of the driving signals of the scanning and data electrodes of the liquid crystal display device, when displaying the 16 gray scales in the liquid crystal display device, using the optimal code system (7, 5, 3) of 3 bits as an application example of the voltage and frame rate modulation method for displaying the gray scales, are as shown in FIG. 14 and TABLE 5.

TABLE 5

| code of the 16 gray scales | driving voltage | | |
|---|---|---|---|
| data code value | 7 | 5 | 3 |
| scanning voltage (Vs) | 26.8 | 22.65 | 17.545 |
| data voltage (Vd) | 1.729 | 1.461 | 1.132 |

The driving voltage of the optimal code system (7, 5, 3), shown in TABLE 5, is derived by the following formulas.

$$V'\text{off} = \sqrt{\left(\frac{7}{3}A + \frac{5}{3}A + A\right)\Big/3}$$

$$Vd1_{LSB} = \sqrt{\frac{9}{15}}\,Vd$$

$$Vs1_{LSB} = \sqrt{\frac{9}{15}}\,Vs$$

$$Vd1_{LSB+1} = \sqrt{\frac{5}{3}} \times Vd1_{LSB}$$

$$Vs1_{LSB+1} = \sqrt{\frac{5}{3}} \times Vs1_{LSB}$$

$$Vd1_{MSB} = \sqrt{\frac{7}{3}} \times Vd1_{LSB}$$

$$Vs1_{MSB} = \sqrt{\frac{7}{3}} \times Vs1_{LSB}$$

Also, the comparison of the characteristics of the driving voltage of the scanning and data electrodes, when displaying the 16 gray scales using the optimal code system of 4 bits (6, 4, 3, 2), with those of the driving voltage of the scanning and data electrodes in case of using the conventional binary code system, is shown in the following table 6.

TABLE 6

| method data code | conventional binary code system | | | | the optimal code system according to the present invention | | | |
|---|---|---|---|---|---|---|---|---|
| value | 8 | 4 | 2 | 1 | 6 | 4 | 3 | 2 |
| voltage Vs of signals driving scanning electrodes | 33.08 | 23.39 | 16.54 | 11.70 | 28.65 | 23.39 | 20.26 | 16.54 |

TABLE 6-continued

| method data code | conventional binary code system | | | | the optimal code system according to the present invention | | | |
|---|---|---|---|---|---|---|---|---|
| value | 8 | 4 | 2 | 1 | 6 | 4 | 3 | 2 |
| voltage Vd of signals driving data electrodes | 2.135 | 1.51 | 1.07 | 0.76 | 1.85 | 1.510 | 1.308 | 1.068 |

The comparison of the effects gained by using the method for displaying the gray scales according to the present invention with the characteristics of the conventional method for displaying the gray scales is shown in TABLE 7.

TABLE 7

| method | conventional binary code system | | the optimal code system according to the present invention | |
|---|---|---|---|---|
| | method 1 | method 2 | method 3 | method 4 |
| Vs (Max) | 33.08 | 29.656 | 26.802 | 28.26 |
| Vd (Max) | 2.135 | 1.914 | 1.729 | 1.85 |
| amount of change of Vs | 21.38 | 14.828 | 9.255 | 12.11 |
| amount of change of Vd | 1.375 | 0.957 | 0.597 | 0.782 |
| number of subframes | 4 | 3 | 3 | 4 |

Methods 1 and 2 in TABLE 7 are the conventional voltage and frame rate modulation methods for displaying the gray scales. In method 1, the 16 gray scales are displayed by configuring the 4 subframes using the weighting value (8:4:2:1) of the picture data. In method 2, the 16 gray scales are displayed by configuring the 3 subframes using the weighting value (4:2:1) of the picture data of the remaining 3 bits after having the least significant bit of the weighting value (8:4:2:1) of the picture data undergo error diffusion processing in the case of the method 1 of the conventional voltage and frame rate modulation method. This is done after having the least significant bit of the weighting value (8:4:2:1) of the picture data undergo space modulation. In method 3, i.e., a first embodiment of the present invention, the 16 gray scales are displayed by configuring the 3 subframes after converting the picture data code, having the conventional weighting value of (8:4:2:1), into the optimal data code having the weighting value of (7:5:3). In method 4, i.e., a second embodiment of the present invention, the 16 gray scales are displayed by configuring the 4 subframes after converting the picture data code, having the conventional weighting value of (8:4:2:1), into the optimal data code having the weighting value of (6:4:3:2). In TABLE 7, the maximum voltages for driving the scanning and data electrodes and the amount of change of the voltage signals for driving the scanning electrodes and the signals for driving the data electrodes, among the respective subframes in the voltage and frame rate modulation method for displaying the gray scales, are derived and compared with one another.

As shown in TABLE 7, in the method for displaying the 16 gray scales using the third method according to the present invention, i.e., the optimal code system (7, 5, 3) of 3 bits, the maximum voltage for driving the scanning electrodes is 26.8 V and that for driving the data electrodes is 1.729 V. Together, these values represent 81% of the maximum voltage signals for driving the scanning and data electrodes in the first method and 90.4% of the maximum voltage signals for driving the scanning and data electrodes in the second method. Also, in the third proposed method, the amount of change of the voltage signals for driving the scanning and data electrodes among the respective subframes are 9.255 V and 0.597 V, which is 43.3% and 62.4% of those in the first and second methods, respectively.

Also, in the fourth method, i.e., the method of displaying the gray scales using the optimal code system (6, 4, 3, 2) of 4 bits, the maximum voltage signals for driving the scanning electrodes is 28.65 V and that for driving the data electrodes is 1.85 V. Together, these values represent 86.6% of the maximum voltage signals for driving the scanning and data electrodes in the first conventional method and 96.6% of those in the second conventional method. Also, in the fourth proposed method, the amount of change of the voltage signals for driving the scanning and data electrodes among the respective subframes are 12.11 V and 0.782 V, which is 56.6% and 81.7% of those in the first and second methods, respectively.

Therefore, it is possible to reduce expenses for the ICs driving the electrodes and to stabilize the display picture and reduce the crosstalk noise caused by the small driving signals by using stable signals for driving the electrodes having a low rate of change. Here, the smaller the driving signals are, the smaller the voltages of differential waves derived at the neighbor electrodes.

The effectiveness of the method for displaying the gray scales according to the present invention increases as the number of the gray scales displayed increases. Also, the previously defined first, second, third, and fourth standards for selecting the optimal code system can be used for intensively improving the characteristics of the LCD driving voltage by selecting the standards in the reverse order (i.e., in the order of the fourth, third, second, and first standards).

Figure 15:
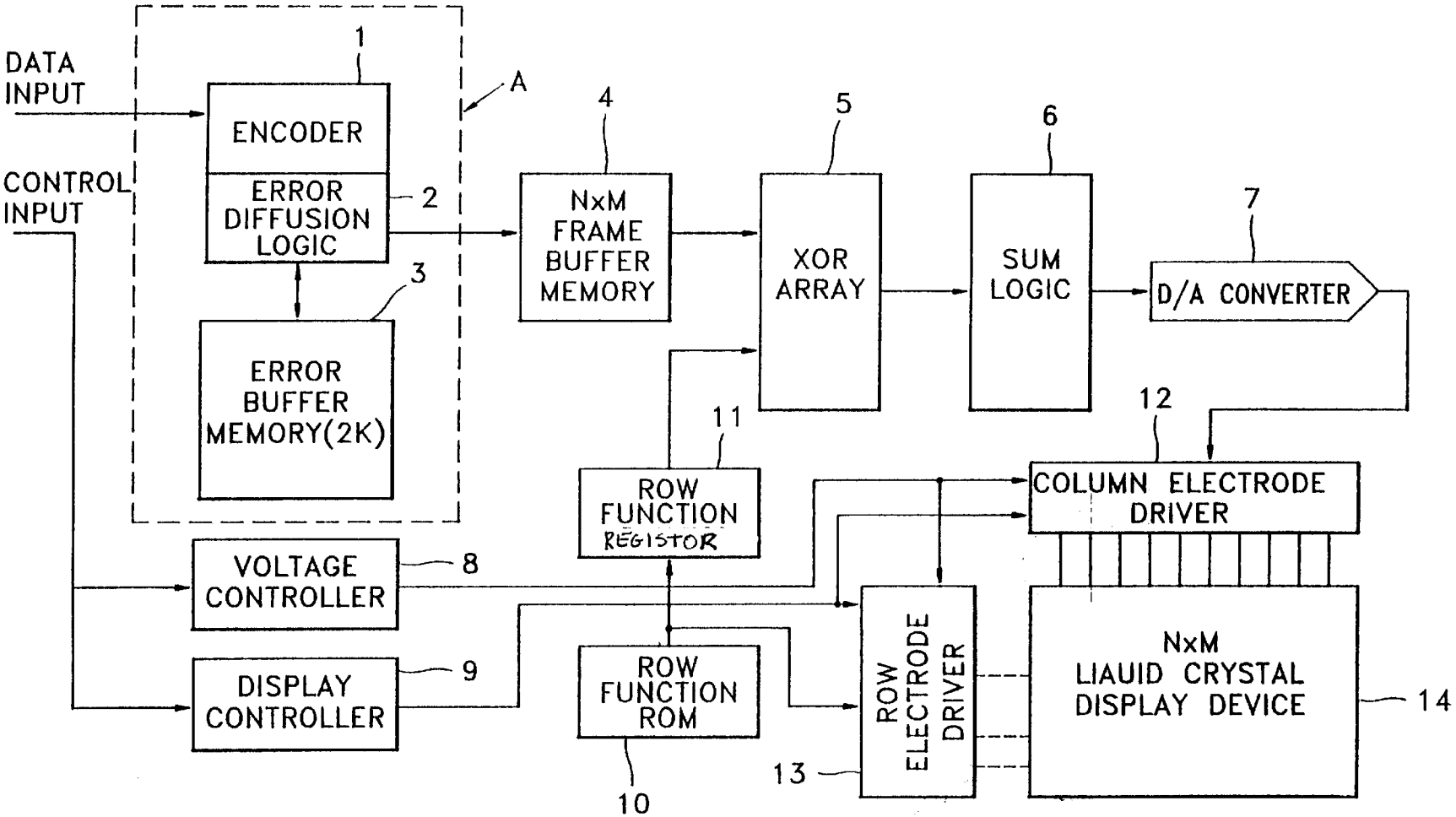
FIG. 15 is a block diagram of a device for driving a liquid crystal display device according to the method for displaying the gray scales according to the present invention.

An example of a device for driving the liquid crystal display, applying the method for displaying the gray scales according to the present invention, is shown in FIG. 15. As shown in block "A" of FIG. 15, the same is realized by adding only an encoder 1, an error diffusion logic 2, and an error buffer memory 3. The blocks labeled as an N×M frame buffer memory 4, an XOR array 5, a sum logic 6, a digital-to-analog converter 7, a voltage controller 8, a display controller 9, a row function ROM 10, a row function register 11, a column driver (a data electrode driver) 12, a row driver (scanning electrode driver) 13, and an N×M liquid crystal display device 14 denote circuits used for applying the MLS method or the AA method.

Figure 2:
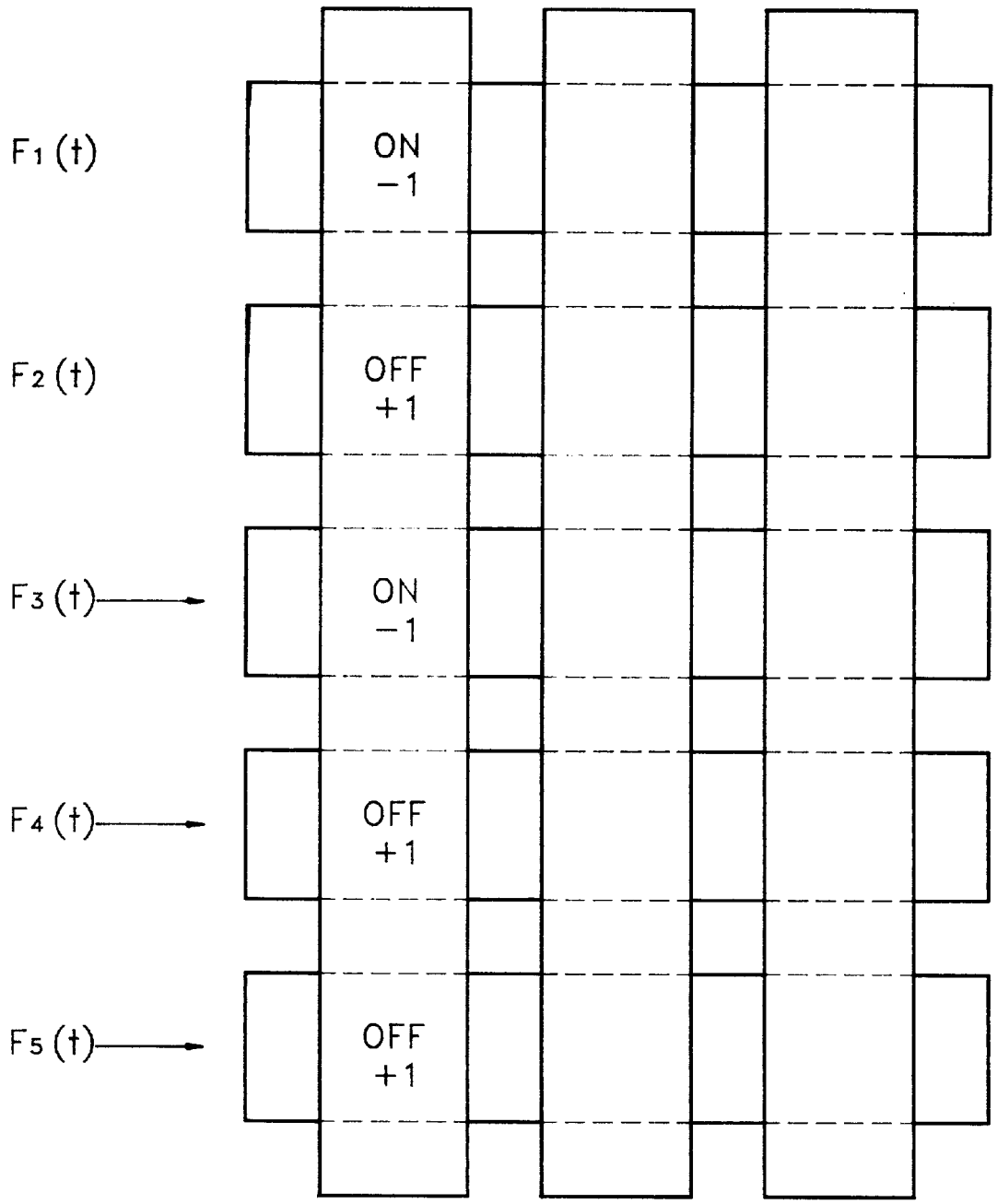
FIG. 2 (PRIOR ART)
FIG. 2 is a diagram showing a method for driving scanning and data electrodes of a conventional active address driving method.
Figure 3:
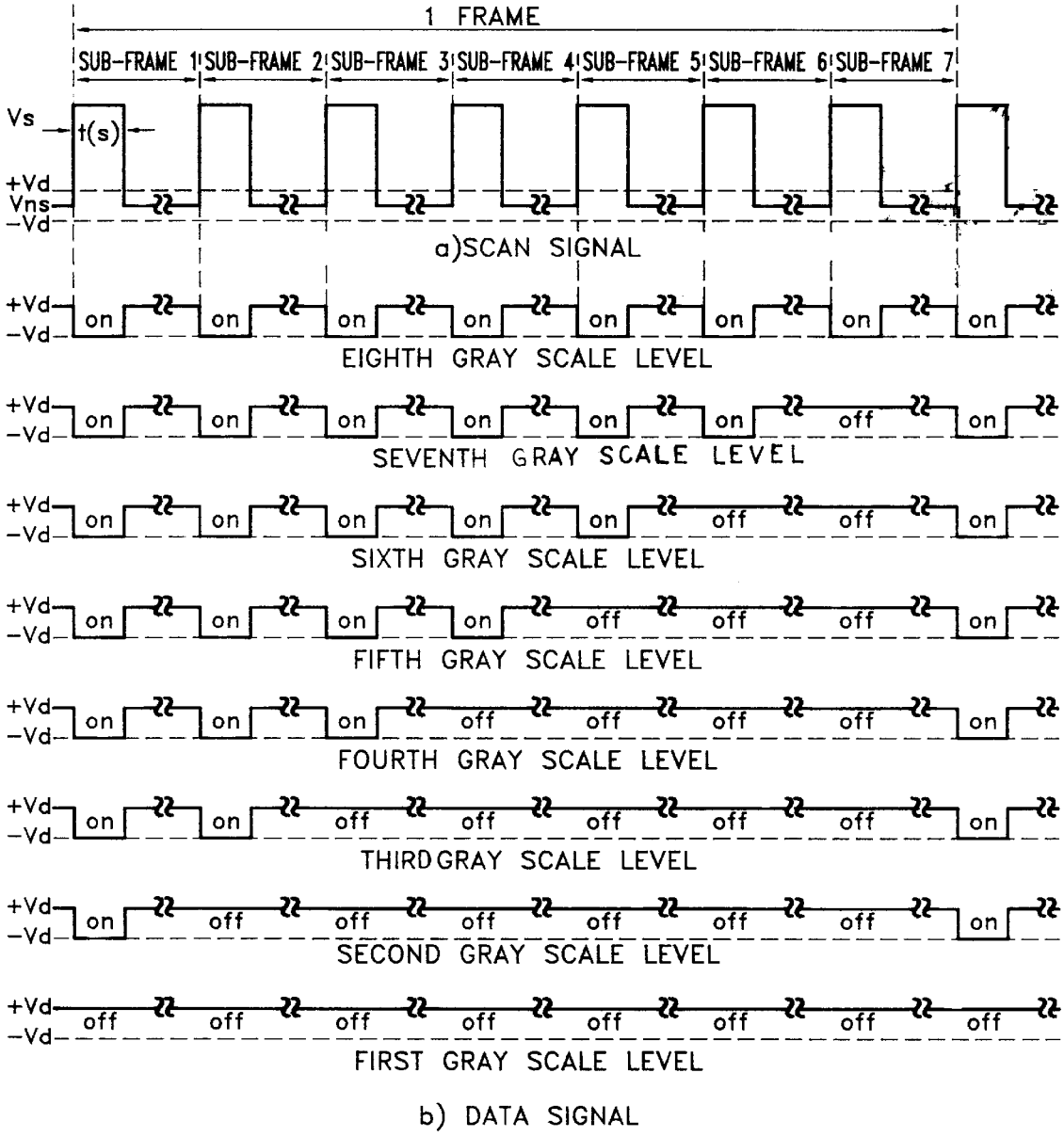
FIG. 3 (PRIOR ART)
FIG. 3 is a waveform diagram of signals driving the scanning electrodes and those for driving the data electrodes of a conventional frame rate modulation method for displaying the eight gray scales.
Figure 4:
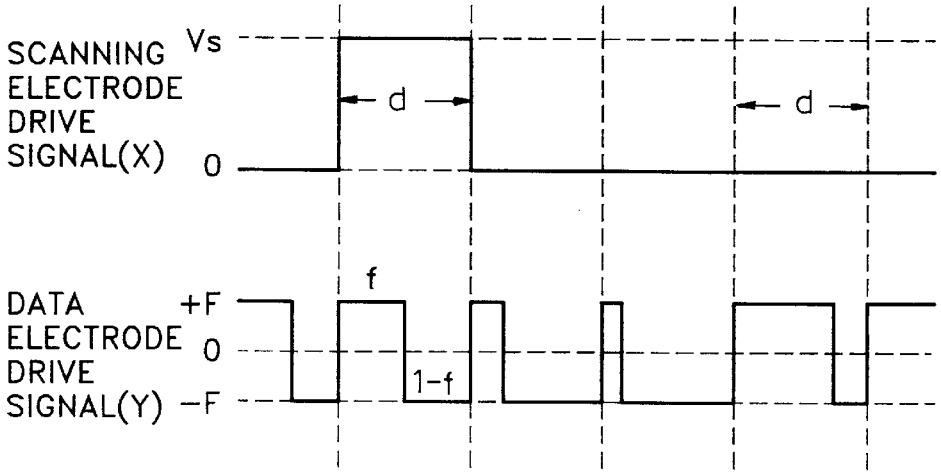
FIG. 4 (PRIOR ART)
FIG. 4 is a waveform diagram of the signals for driving the scanning electrodes and those for driving the data electrodes of a conventional amplitude modulation method for displaying the gray scales.
Figure 5:
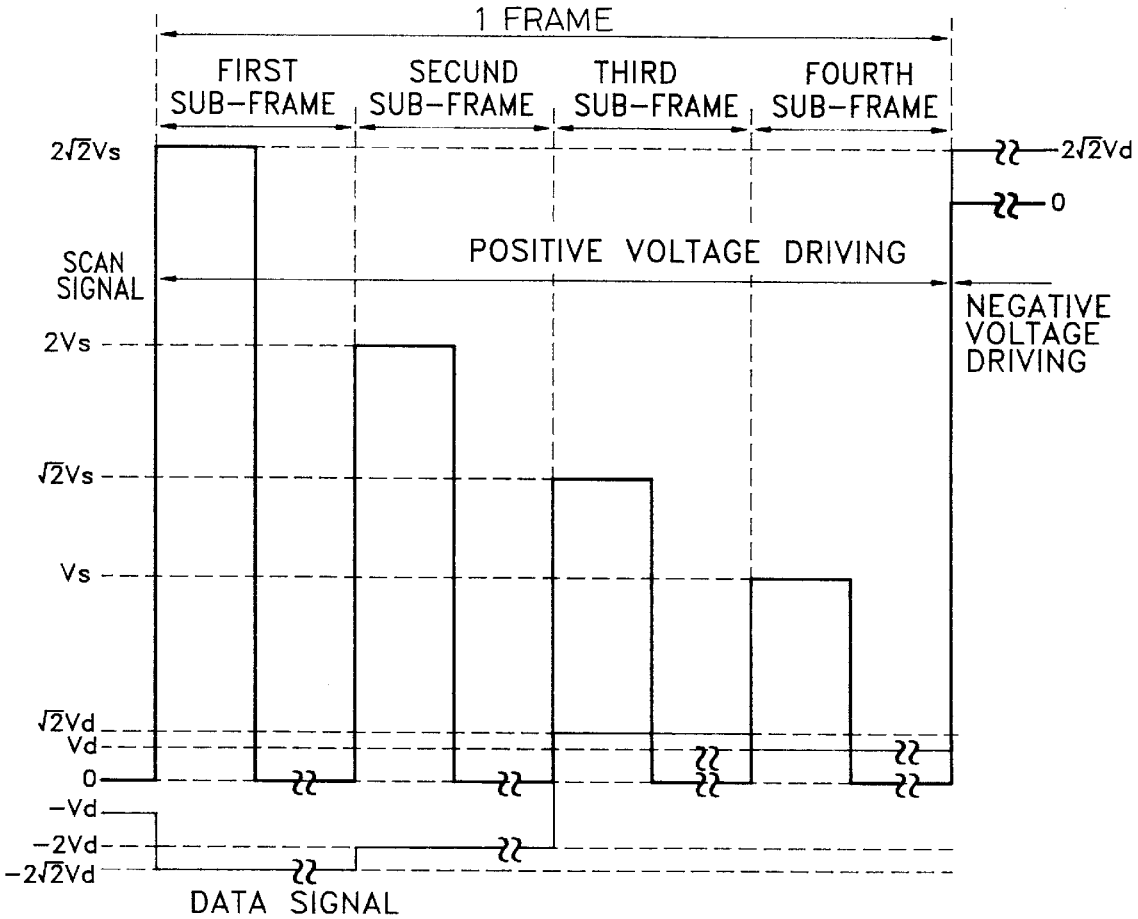
FIG. 5 (PRIOR ART)
FIG. 5 is a waveform diagram of the signals for driving the scanning electrodes and those for driving the data electrodes of a conventional voltage and frame rate modulation method for displaying the gray scales.
Figure 6:
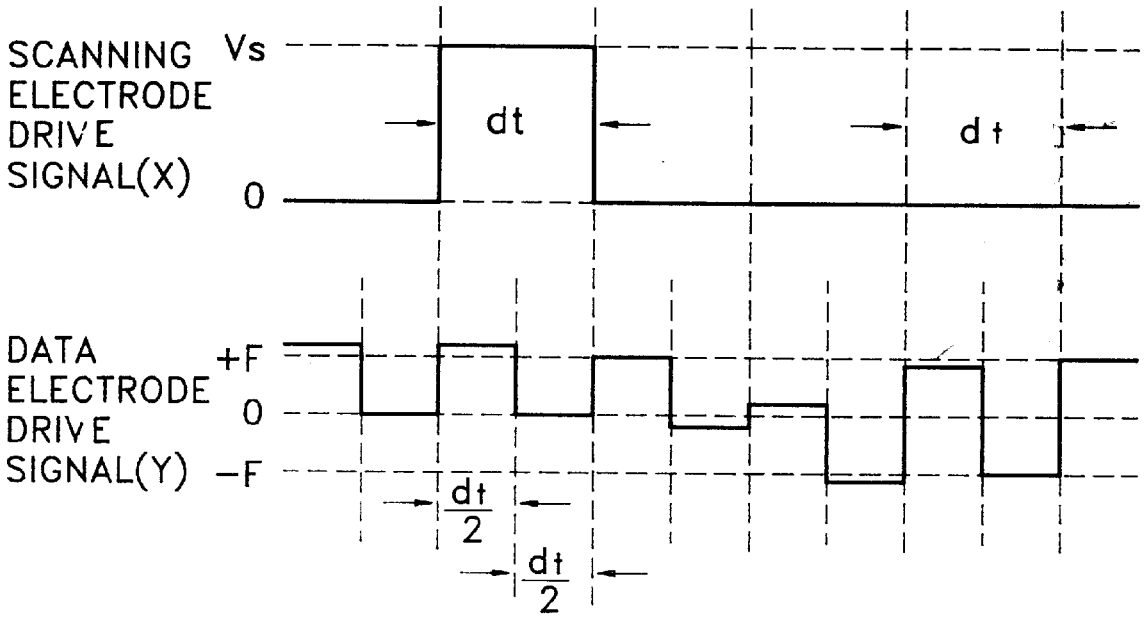
FIG. 6 (PRIOR ART)
FIG. 6 is a waveform diagram of the signals for driving the scanning electrodes and those for driving the data electrodes of a conventional voltage amplitude modulation method for displaying the gray scales.
Figure 7:
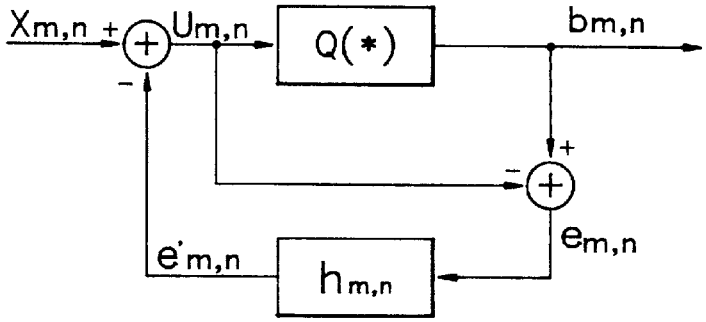
FIG. 7 (PRIOR ART)
FIG. 7 is a block diagram of an error diffusion system.
Figure 8:
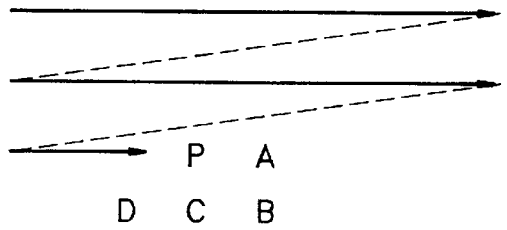
FIG. 8 (PRIOR ART)
FIG. 8 is a diagram showing an example of an error diffusion method.
Figure 9:
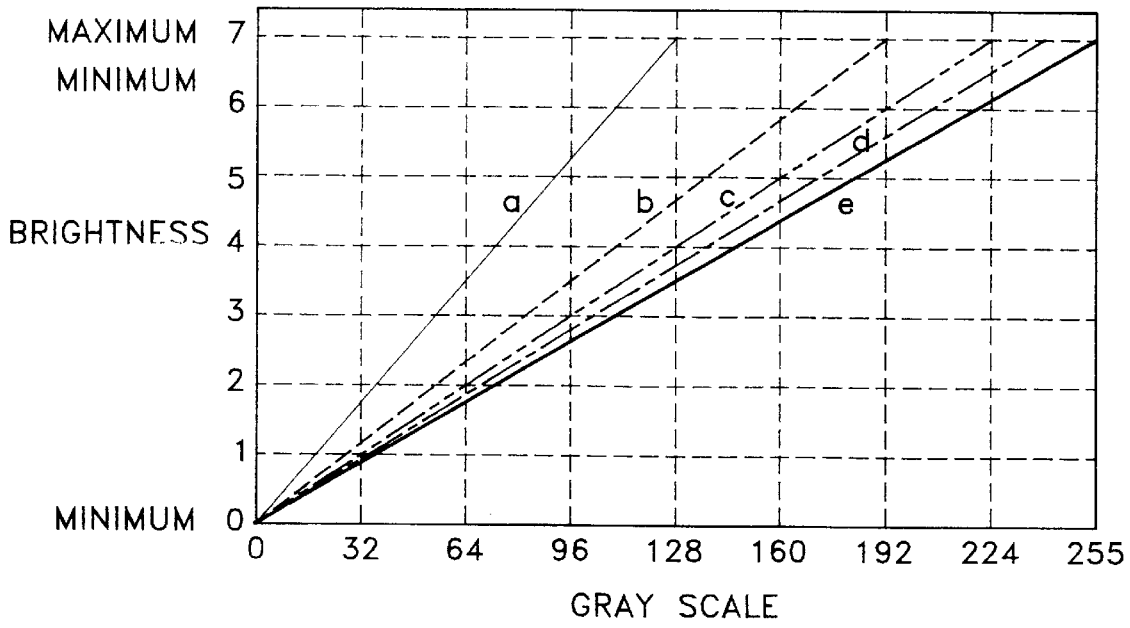
FIG. 9 (PRIOR ART)
FIG. 9 is a graph showing the number of gray scales in a hardware and its ability of displaying the gray scales in a data processing system.

Here, the encoder 1 converts (encodes) the input binary coded picture data (8:4:2:1) to the optimal code of (7:5:3:1:1). The error diffusion logic 2 performs error diffusion processing on the 2 lower bits of the code (7:5:3:1:1) using the error bit information kept in the error buffer memory 3 and outputs the code (7:5:3) which underwent the error diffusion processing to the N×M frame buffer memory 4. The N×M frame buffer memory 4 temporarily stores the applied code which underwent error diffusion processing of (7:5:3), thus carrying on the data processing smoothly. The exclusive OR (XOR) array 5 receives the code which underwent the error diffusion processing from the N×M frame buffer memory 4 and the row function information $F_1(t)$~$F_5(t)$ from the row function register 11, performs an XOR logic, and outputs the result to the sum logic 6. The sum logic 6 produces the data driving signals such as $G_1(t)=-cF_1(t)+cF_2(t)-cF_3(t)+cF_4(t)+cF_5(t)$ according to the active address method, as shown in FIG. 2, by synthesizing the XOR logic values $-cF_1(t)$, $cF_2(t)$, $-cF_3(t)$, $cF_4(t)$, and $cF_5(t)$ of the code which underwent the XOR logic processing in the XOR array 5. The digital-to-analog converter 7 converts the signals for driving the data electrodes produced by the sum logic 6 to analog signals and outputs them to the column driver (the data electrode driver) 12. The column driver 12 sequentially drives the data electrodes of the liquid crystal display device 14 according to the controlling signals of the display controller 9, by the appropriate voltage signals converted to analog signals and supplied from the voltage controller 8. The voltage controller 8 outputs the required voltage to the column driver 12 and row driver 13. The row function ROM 10 stores the function (the information) for selecting the scanning electrodes. The row function register 11 temporarily stores the row function which is to be output to the XOR array 5. The display controller 9 outputs the controlling signals for driving the scanning and data electrodes in the appropriate order, respectively.

The operation of the driving system which is constructed as described above will now be described.

First, the encoder 1 converts the input data to the optimal code of M bits (for example, the weighting value 7:5:3:1:1 of 5 bits) when the picture data of the binary code of N bits (for example, the weighting value 8:4:2:1 of binary code of 4 bits) is input to the encoder 1. In the optimal code of M bits (5 bits), the error diffusion logic 2 error-diffuses the n lower bits of M bits (the 2 lower bits of 7:5:3:1:1) using the error bit information stored in the error buffer memory 3 and produces the code which underwent error diffusion processing of (M−n) bits (7:5:3). The code which underwent error diffusion processing of (M−n) bits undergoes the XOR logic processing (for example, the same becomes the XOR logic values of $-cF_1(t)$, $cF_2(t)$, $-cF_3(t)$, $cF_4(t)$, $cF_5(t)$) with the row function for selecting the scanning electrodes (for example, $F_1(t)$~$F_5(t)$) offered from the row function ROM 10 and is synthesized into the signals for driving the digital data electrode driving signals (for example, $G_1(t)=-cF_1(t)+cF_2(t)-cF_3(t)+cF_4(t)+cF_5(t)$) in the sum logic 6. The synthesized digital signals for driving the data electrodes are converted to analog signals by the digital-to-analog converter 7 and output to the column driver 12. The signals, converted into analog signals and output to the column driver 12, are converted by the appropriate voltage output from the voltage controller 8 and the resulting signal sequentially drive the data electrodes of the liquid crystal display 14 according to the controlling signals of the display controller 9. The scanning electrodes are sequentially selected and driven by the scanning electrode driving signals which are formed at the row electrode 13 by the row function for selecting the scanning electrodes output from the row function ROM 10, the appropriate voltage output from the voltage controller 8 and display control signals output from controller 9.

The device for driving the conventional binary picture data code system by converting it into a different code system can be applied to all of the display devices such as the cathode-ray tube, PDP, and the electroluminescent display, etc.

As described above, in the method for displaying the gray scales of an image display unit according to the present invention, the conventional binary code system is not used and the picture data of N bits of the binary data code system are converted to the optimal data code of M bits which is greater than or equal to N, considering the system circumstances of the image display unit, i.e., the number of subframes for displaying the gray scales and the conditions of a driving voltage. In the first standard for selecting the code, the maximum value of the upper (M−n) bit data displayed by the optimal code system should be equal to the maximum value of the picture data displayed according to the binary code system. In the second standard for selecting the code, among the new gray levels generated by the error diffusion method, the number of adjacent gray levels should be smallest. The N-bit picture data of the binary data code system should be converted to the optimal M-bit data code composed of the picture data code of (M−n) bits selected to satisfy the first and second standards for selecting the code and the additional code of n bits for space modulation. Moreover, when there exist more than two code systems which simultaneously satisfy the first and second standards for selecting the code, the picture data of N bits are converted into the optimal data code of M bits to satisfy the third standard for selecting the code wherein the code system should minimize the difference in the weighting values between data values of the most significant bit and the least significant bit and the fourth standard for selecting the code wherein the code system should minimize the difference in the weighting values between respective data bits. Then, the error diffusion processing value of n bits, among the picture data converted into the optimal M bits, undergo error diffusion processing. The gray scales of the picture data code of (M−n) bits, wherein n bits underwent the error diffusion processing, are displayed using the voltage amplitude modulation method or the voltage and frame rate modulation method. Thus, it is possible to prevent the saturation of gray scales generated when displaying more than two gray scales by adding the space modulation method to all the methods for displaying the gray scales, to sharply lower the voltages of the scanning electrode driving signal and the data electrode driving signal, to sharply reduce the difference of the driving voltages between the subframes, to minimize the deterioration of picture quality due to the space modulation, and to further increase the driving efficiency as the number of the gray scales desired to display (the number of the subframes) increase with the limited ability of displaying the gray scales.

What is claimed is:

1. A method for displaying gray scales of an image display unit, comprising the steps of:

determining an error diffusion processing value of input picture data of N bits as n bits which is less than N;

converting said picture data of N bits into the optimal data code of M bits which is larger than or equal to N and is composed of a picture data code of (M−n) bits selected to satisfy the first standard for selecting the code wherein the maximum value of the data of the upper (M−n) bits displayed by the optimal code system should be equal to or larger than the maximum value of the picture data displayed according to the binary code system and the second standard for selecting the code wherein, among the new gray levels generated by the error diffusion method, the number of adjacent gray levels should be smallest and an additional code of n bits for space modulation;

error-diffusion-processing the n bits of said error diffusion processing value among the picture data which are converted into said optimal M bits; and displaying the picture data code of said (M−n) bits wherein said n bits undergo error diffusion processing as a picture.

2. A method for displaying gray scales of an image display unit as claimed in claim 1, wherein said step for converting said picture data of N bits into the optimal data code of M bits is performed to satisfy the third standard for selecting the code, wherein the optimal code system should minimize the difference of the weighting values of the data values between the most significant bit and the least significant bit and the fourth standard for selecting the code, wherein the optimal code system should minimize the difference of the weighting values between the respective data bits when there exist more than two code systems which simultaneously satisfy said first and second standards for selecting the code.

3. A method for displaying gray scales of an image display unit as claimed in claim 1, wherein the gray scales of said picture data code of (M−n) bits are displayed using the voltage amplitude modulation method or the voltage and frame rate modulation method in said step for displaying said picture.

4. A method for displaying gray scales of an image display unit as claimed in claim 2, wherein the gray scales of said picture data code of (M−n) bits are displayed using the voltage amplitude modulation method or the voltage and frame rate modulation method in said step for displaying said picture.

5. A method for displaying gray scales of an image display unit, comprising the steps of:

determining an error diffusion processing value of input picture data of N bits as n bits which is smaller than N;

converting said picture data of N bits into the optimal data code of M bits which is greater than or equal to N bits and composed of a picture data code of (M−n) bits selected to satisfy the third standard for selecting the code, wherein the optimal code system should minimize the difference of the weighting values of the data values between the most significant bit and the least significant bit and the fourth standard for selecting the code, wherein the optimal code system should minimize the difference of the weighting values between the respective data bits, and an additional code of n bits for a space modulation;

error-diffusion-processing n bits being said error diffusion processing value among the picture data which are converted into said optimal M bits; and displaying the picture data code of said (M−n) bits wherein said n bits undergo the error diffusion processing as a picture.

6. A method for displaying gray scales of an image display unit as claimed in claim 5, wherein said step for converting said picture data of N bits into the optimal data code of M bits is performed to satisfy the first standard for selecting the code, wherein the maximum value of the data displayed by the optimal code system should be equal to the maximum value of the picture data displayed according to the binary code system and the second standard for selecting the code wherein, among the new gray levels generated by the error diffusion method, the numbers of adjacent gray levels should be smallest, when there exist more than two code systems which simultaneously satisfy said third and fourth standards for selecting the code.

7. A method for displaying gray scales of an image display unit as claimed in claim 6, wherein the gray scales of said picture data code of M−n bit are displayed using the voltage amplitude modulation method or the voltage and frame rate modulation method in said step for displaying said picture.

8. A method for displaying gray scales of an image display unit as claimed in claim 5, wherein the gray scales of said picture data code of M−n bit are displayed using the voltage amplitude modulation method or the voltage and frame rate modulation method in said step for displaying said picture.

* * * * *